United States Patent [19]

Glick

[11] Patent Number: 5,058,850

[45] Date of Patent: Oct. 22, 1991

[54] EASEL FOR PICTURE FRAME

[76] Inventor: Ike N. Glick, 7103 - 111 Street, Edmonton, Alberta, Canada, T6G 1G9

[21] Appl. No.: 360,598

[22] Filed: Jun. 2, 1989

[51] Int. Cl.[5] ..... A47G 29/00

[52] U.S. Cl. ..... 248/450; 248/460; 248/473

[58] Field of Search ..... 248/441.1, 450, 451, 248/453, 454, 459, 460, 466, 469, 472, 473, 174; 40/152.1; 206/45.24

[56] References Cited

U.S. PATENT DOCUMENTS

| | | | |
|---|---|---|---|
| D. 256,203 | 8/1980 | Brothers | 248/473 |
| 732,828 | 7/1903 | Christopher | 248/450 |
| 777,658 | 12/1904 | Bird | 248/460 |
| 1,341,560 | 5/1920 | Johnson | 248/460 |
| 1,399,507 | 12/1921 | Mills | 248/459 |
| 1,681,527 | 8/1928 | Egan | 248/473 |
| 2,832,176 | 4/1958 | Vergeer | 206/45.24 |

FOREIGN PATENT DOCUMENTS

| | | | |
|---|---|---|---|
| 113330 | 2/1918 | United Kingdom | 248/459 |

*Primary Examiner*—Ramon O. Ramirez
*Assistant Examiner*—Robert A. Olson
*Attorney, Agent, or Firm*—E. Peter Johnson

[57] ABSTRACT

The easel is a flat, generally diamond-shaped member formed of non-scratching stiff, resilient material, such as plastic. The member has a line of weakness extending thereacross between its opposed oblique angle points. The member can therefore easily be bent along the line of weakness to adopt a two-sided pyramidal form having rearwardly inclined, load-supporting edges and bottom edges. Means are provided along the load-supporting edges for disengageably supporting and frictionally interlocking with a picture frame or flat sheet to be displayed in spaced, non-scratching arrangement above a flat support surface, such as a table top. In the case of a channel-type picture frame, the means may comprise opposed L-shaped slots extending inwardly from each load-supporting edge a short distance above the bottom edge. The L-shaped slots form a T-shaped member. The T-shaped member can frictionally interlock with the base channel of a picture frame, to suspend the frame in a rearwardly inclined display position. Because each T-shaped member is formed at a point along its load-supporting edge, which point is spaced above the bottom edge, the picture frame is suspended above and out of contact with the table support surface. In use, the side walls of the pyramidal member can be adjusted together or apart to alter the angle of inclination of the picture frame. The frictional interlock between the T-shaped members and the channel ensures that the spacing of the side walls is maintained.

1 Claim, 2 Drawing Sheets

EASEL FOR PICTURE FRAME

FIELD OF THE INVENTION

This invention relates to an easel which finds application in supporting a picture frame or flat display card in an upright display position. The easel is adapted to suspend the picture frame or card spaced above a flat horizontal support surface, such as that provided by a table.

BACKGROUND OF THE INVENTION

The invention has been developed in conjunction with channel-type picture frames. Therefore it will first be described in conjunction with that particular application and the problems to be solved in connection therewith. However, the easel finds other applications beyond channel-type picture frames, as is set forth below.

The conventional means for propping up a picture frame in an upright display position on a flat surface is referred to as an "easel back".

An easel back typically involves the combination of a stiff flat plate, that fits into the rear opening of the picture frame and forms a backing for the displayed picture sheet, and an elongate stiff non-scratching leg that is hinged at its upper end to the plate. The leg can be swung out rearwardly from the plate through a limited arc to find footing on the table surface. The angled leg thus props up the plate and picture frame in a slightly rearwardly inclined position.

There are various shortcomings associated with the conventional easel back. These include:

- That it is necessary to stock a range of easel backs of varying dimensions, as each standard size of picture frame typically requires an easel back that precisely fits its dimensions;
- That there is only a single angle of picture frame inclination obtainable with a particular easel back and this angle cannot be varied;
- That the assembly is relatively unstable when bumped, so that the picture frame may topple over; and
- That the easel back is unsuitable for use with a metal channel frame, such as a Nielsen-type frame, because the frame rests on and may scratch the support surface. This problem has largely precluded the Nielsen-type frame from being used in stand-up applications. Thus the wide range of colors and profiles associated with the Nielsen-type frames is unavailable for stand-up application.

With this background in mind, it would be desirable to provide an easel:

- which is flat in its shipping configuration and which can easily be packaged with the picture frame;
- which can be used with a range of picture frames of different sizes, shapes, colors and profiles;
- which can be adjusted to change the angle of inclination of the picture frame;
- which provides an improved measure of stability to the picture frame; and
- which supports or suspends the picture frame above the support surface so that scratching of such support surface is avoided.

Such objectives have been achieved in accordance with the present invention, which provides an easel which finds preferred use with a type of picture frame commonly known in the industry as a "Nielsen-type frame". The Neilsen-type frame is formed of extruded aluminum channel side members. Each channel side member has a flat forward-facing main wall, which lies in the main plane of the frame, and a pair of spaced side walls extending rearwardly and perpendicularly from the margins of the main wall. A lip extends inwardly from the upper margin of each side wall, parallel to the main wall. In section, therefore, the channel side member is generally C-shaped.

SUMMARY OF THE INVENTION

An easel in accordance with the invention comprises a generally diamond-shaped flat member formed of stiff resilient material, such as low impact polyethylene. Preferably, the opposed side edges of the member are parallel. Preferably, a line of weakness extends transversely across the member between those opposed points of the member forming oblique angles. The member can be bent along the line of weakness to adopt a generally conical configuration when the operative mode. Stated otherwise, the member forms a two-sided pyramid when in this operative mode. When the member is in the conical configuration, two side edges, defining an open side of the structure, provide the edges that contact the frame's base channel and the supported member, which typically is the back plate of a picture frame. These two side edges are referred to as the supporting edges. Each such supporting edge has means for disengageably and frictionally interlocking with the base channel. Such means are each located part way up the supporting edges. Stated otherwise, each such interlocking means is spaced above but is close to the adjacent bottom edge of the conically-formed member. In a preferred form, the easel member forms two pairs of generally L-shaped slots, the slots of each pair being spaced apart a short distance and positioned along the length of a supporting edge. The L-shaped slots extend inwardly from the supporting edge in opposed relation to form a generally T-shaped member. The T-shaped members formed at the two supporting edges may be snapped into the C-shaped groove formed by the frame base channel to interlock therewith. Each T-shaped member preferably can be manually moved along the channel groove when emplaced therein, but frictionally engages the channel walls to resist slippage.

In use, the easel member is bent along the line of weakness and the two T-shaped members are snapped into locking engagement with the frame base channel. The supported member tilts rearwardly to rest against the supporting edges. Tension is developed in the structure of the easel member, as the T-shaped load is applied and the members prevent the bottom end of the frame from sliding down and forward. The weight of the loaded frame acts downwardly and rearwardly on the conically-shaped easel member, which bears the load and whose side walls are prevented from spreading by the frictional locking interaction of the T-shaped members and the base channel. As the T-shaped members are spaced above the bottom edges of the generally conically-formed easel member, they act to suspend the frame above the flat support surface, thereby preventing the frame from scratching the support surface. The side walls of the conically-formed easel member may be manually moved closer together or further apart to change the angle of the frame-supporting edges and thereby change the tilt of the frame. The stiff but still somewhat pliable nature of the easel material permits this adjustment to be successfully accomplished and the frictional tensioned interlocking relationship of the T-shaped members and the base channel ensures that the selected transverse spacing of the easel member side walls is maintained.

The easel member may consist of a solid diamond in the flattened form or there may be cut-outs formed in the side walls, as shown in the drawing. The key features of both versions of the article are:

- the upwardly inclined load-carrying or propping "spine" provided by that section of the member adjacent to the line of weakness;
- the frictional interlock/suspension means provided close to the base of the supporting edges, said means being spaced above the bottom edges so that the frame is suspended above the support surface contacted by said bottom edges;
- the tensioning effect created in the easel member as a result of the rearwardly inclined and suspended load tending to spread the easel member side walls, which tendency is counteracted by the engagement of the interlock/suspension means;
- the side wall sections tieing the interlock means with the base end of the spine; and
- the stiff but resilient nature of the material from which the member is formed.

In an alternative embodiment, the easel member may form a hook-like member in place of the T-shaped member. The hook-like members are formed at points along the supporting edges and are spaced above the bottom edges. The hook-like members are adapted to receive and suspend a display card in spaced arrangement above the support surface. The inner surfaces of the hook-like members are operative to frictionally engage the card surface to prevent spreading of the sides of the easel member.

Broadly stated the invention is an easel, for use with a generally flat supported member having a horizontal channel at its lower end, comprising: a generally diamond-shaped and flat first member formed of stiff resilient material, said first member having a line of weakness extending transversely thereof between its oblique points, whereby the first member may be bent along the line of weakness to adopt a generally conical configuration wherein the first member has, in such operative conical mode, load-supporting edges along one open side of the first member and bottom edges along the other open side of the member, said load-supporting edges being rearwardly inclined; each load-supporting edge having means, spaced above but close to the adjacent bottom edge, for disengageably and frictionally interlocking with the channel, said conical member forming a pair of generally L-shaped slots spaced apart along the length of each load-supporting edge and extending inwardly from the edge to form a generally T-shaped member, whereby the slots and T-shaped member provide the interlocking means; whereby in the operative conical mode the first member can interlock with the channel to suspend and support the channel and its supported member, the load-supporting edges are rearwardly inclined to support the supported member in a correspondingly upstanding and inclined position, and the side walls of the first member may be adjusted laterally to alter the inclination of the load-supporting edges while the frictional interlock will maintain the selected spacing of said walls.

DESCRIPTION OF THE PREFERRED EMBODIMENT

The easel comprises a flat generally diamond-shaped member 1 formed of non-scratching stiff resilient material. Typically the member 1 may have a thickness of 0.055 mm and be formed of low impact polyethylene, such as that sold under the trade mark Polyblend by the Polyblend Corporation of St. Charles, Ill.

The opposed side edges 2, 5 and 3, 4 of the member 1 are parallel. The side edges 2, 3 are referred to as the load-supporting edges. The side edges 4, 5 are referred to as the bottom edges.

Figure 1:
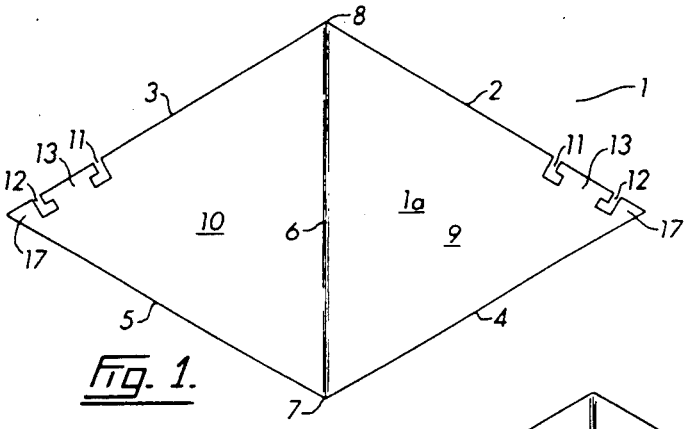
FIG. 1 is a perspective plan view of one form of the easel member.
Figure 5:
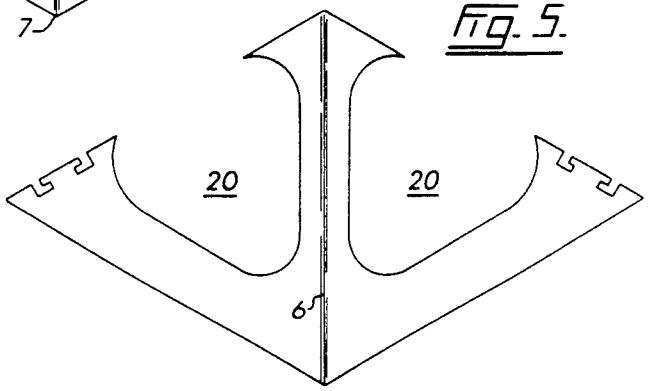
FIG. 5 is a perspective view of an easel member having cut-outs formed in its side walls to save material, said easel member being in the conical mode.
Figure 2:
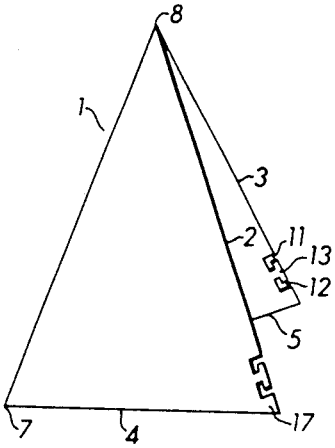
FIG. 2 is a perspective view showing the easel member of FIG. 1 bent into the substantially conical or pyramidal configuration, ready for application to a picture frame.

A line of weakness 6 extends transversely of the member 1 to connect the oblique angle points 7, 8. The line of weakness provides a hinge about which the triangular side walls sections 9, 10 of the member 1 may be bent to form it into the conical or two-sided pyramidal configuration shown in FIGS. 2 and 3. When so formed, the load-supporting edges 2, 3 are rearwardly inclined. As shown in FIG. 5, the side walls 9, 10 may have cut-outs 20 formed therein to save material.

Along each load-supporting edge 2, 3 the member 1 is formed to define a pair of opposed L-shaped slots 11, 12. The slots 11, 12 in turn define a T-shaped member 13.

The T-shaped members 13 are dimensioned to snap into the groove 14 of the base channel 15 of a picture frame 16. Each T-shaped member 13 snugly engages the walls of the base channel 15 to provide a frictional interlock therewith.

Figure 3:
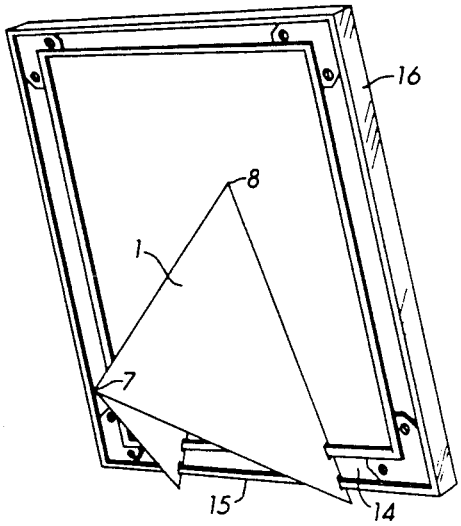
FIG. 3 is a perspective view showing the easel member interlocked with the base channel of a picture frame.
Figure 4:
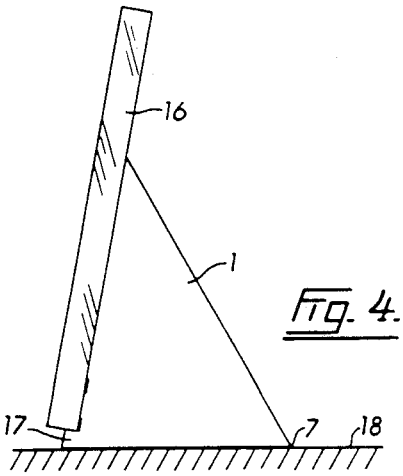
FIG. 4 is a side view showing a picture frame interlocked with and supported by an easel member in the operative conical mode.

As shown in FIGS. 3–5, the frame 16 is suspended on and supported by the easel member 1. The "feet" 17 (those portions of the member 1 directly beneath the lowermost L-shaped slots 11, 12) space the base channel 15 above the horizontal support member 18 (which could be a table).

The triangular side walls 9, 10 can be manually moved closer together or further apart to alter the angle of inclination of the load-supporting edges 2, 3. The frictional interlock, created by the interaction of the surfaces of the slots 11, 12, the T-shaped member 13, the feet 17, and the surfaces of the channel 15, functions to prevent the side walls 9, 10 from moving once they have been set.

Figure 6:
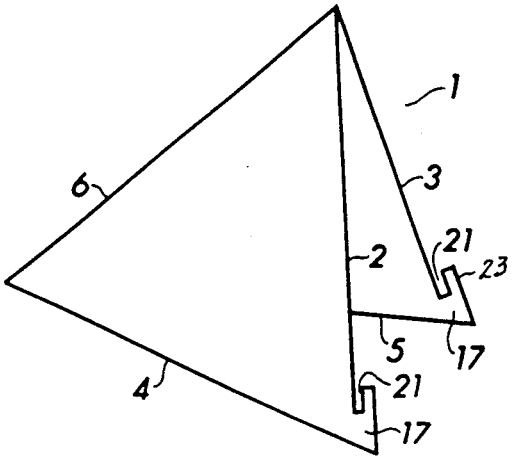
FIG. 6 is a perspective view of an alternative embodiment of the easel.
Figure 7:
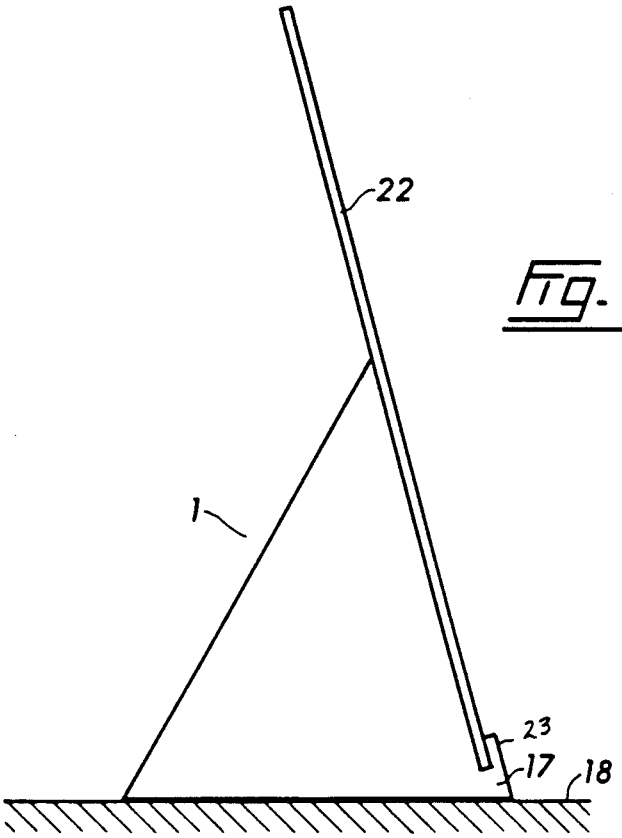
FIG. 7 is a side view showing the embodiment of FIG. 6 supporting a flat display card.

In the alternative embodiment shown in FIGS. 6–7, the member 1 is formed with hook-shaped members 23 which form an upwardly directed slot 21 along each load-supporting edge 2, 3. The hook-shaped members 23 are positioned in spaced relation above the bottom edges 4, 5. The slots 21 are adapted to receive and support a display card 22 in spaced relation above a support member 18.

The scope of protection to be accorded the invention is set forth in the claims now following.

The embodiments of the invention in which an exclusive property or privilege is claimed are defined as follows:

1. An easel, for use with a generally flat supported member having a horizontal channel at its lower end, comprising:

a generally diamond-shaped and flat first member formed of stiff resilient material, said first member having a line of weakness extending transversely thereof between its oblique points, whereby the first member may be bent along the line of weakness to adopt a generally conical configuration wherein the first member has, in such operative conical mode, load-supporting edges along one open side of the first member and bottom edges along the other open side of the member, said load-supporting edges being rearwardly inclined;

each load-supporting edge having means, spaced above but close to the adjacent bottom edge, for disengageably and frictionally interlocking with the channel, said conical member forming a pair of generally L-shaped slots spaced apart along the length of each load-supporting edge and extending inwardly from the edge to form a generally T-shaped member, whereby the slots and T-shaped member provide the interlocking means;

whereby in the operative conical mode the first member can interlock with the channel to suspend and support the channel and its supported member, the load-supporting edges are rearwardly inclined to support the supported member in a correspondingly upstanding and inclined position, and the side walls of the first member may be adjusted laterally to alter the inclination of the load-supporting edges while the frictional interlock will maintain the selected spacing of said walls.

* * * * *